US006553581B1

(12) United States Patent
Lee

(10) Patent No.: US 6,553,581 B1
(45) Date of Patent: Apr. 29, 2003

(54) ODOR EXHAUSTING APPARATUS FOR WATER CLOSET

(76) Inventor: Doo-gyun Lee, 1-19, Nongsung-dong, Seo-gu, Kwangju, 502-200 (KR)

( * ) Notice: Subject to any disclaimer, the term of this patent is extended or adjusted under 35 U.S.C. 154(b) by 0 days.

(21) Appl. No.: 10/049,019

(22) PCT Filed: Jul. 26, 2000

(86) PCT No.: PCT/KR00/00807

§ 371 (c)(1),
(2), (4) Date: Jun. 6, 2002

(87) PCT Pub. No.: WO01/11153

PCT Pub. Date: Feb. 15, 2001

(30) Foreign Application Priority Data

Aug. 9, 1999 (KR) ..... 99-16249
Oct. 20, 1999 (KR) ..... 99-45638

(51) Int. Cl.[7] ..... A47K 13/00; E04D 9/04
(52) U.S. Cl. ..... 4/217
(58) Field of Search ..... 4/213, 216, 217

(56) References Cited

U.S. PATENT DOCUMENTS 3,108,289 A * 10/1963 Smith ..... 4/217 X
3,916,459 A * 11/1975 Ivancevic ..... 4/217 X
4,780,913 A 11/1988 Williams
5,991,934 A * 11/1999 Hsu ..... 4/217
6,055,677 A * 5/2000 McKinley ..... 4/217

FOREIGN PATENT DOCUMENTS

| | | |
|---|---|---|
| JP | 49-55852 | 5/1974 |
| KR | 90-6772 | 4/1990 |
| KR | 91-15764 | 9/1991 |
| KR | 96-8226 | 3/1996 |

* cited by examiner

*Primary Examiner*—Charles E. Phillips
(74) *Attorney, Agent, or Firm*—George T. Marcou; Kilpatrick Stockton LLP

(57) ABSTRACT

The object of this invention is to provide a toilet and an odor exhausting apparatus for such toilets, designed to quickly suck odor from the toilet bowl to a chimney pot installed on the rooftop during defecation or urination so as to quickly expel the odor into the atmosphere outside a house. In the apparatus, the seat (3) has a cavity (1*d*), a plurality of odor suction ports (1*f*), a tubular hinge joint (2) and an odor outlet port (1*e*). A connection pipe (6), having an inlet port (6*a*), is set within the hinge joint (2). A seat cover (8) is coupled to the connection pipe (6) through a toothed engagement. A tubular shaft (7), having an inlet port (7*a*), is rotatably set within the connection pipe (6), and communicates with the atmosphere outside the house through a pipeline (12). When the cover (8) is closed, the port (7*a*) is closed by the sidewall of the connection pipe (6). However, when the cover (8) is opened, the port (7*a*) communicates with the port (1*e*) of the seat (3) through the port (6*a*) of the connection pipe (6), thus automatically expelling odor from the toilet bowl to the atmosphere due to suction force of the pipeline.

6 Claims, 8 Drawing Sheets

(a)

(b)

ODOR EXHAUSTING APPARATUS FOR WATER CLOSET

TECHNICAL FIELD

The present invention relates, in general, to a toilet and an odor exhausting apparatus for such toilets, designed to quickly suck odor from the toilet bowl to a chimney pot installed on the rooftop while relieving one's bowels so as to quickly expel the odor into the atmosphere through the chimney pot and, more particularly, to a toilet and an odor exhausting apparatus for such toilets, with a cavity having a plurality of odor suction ports and being defined in the seat of the toilet, a hollow connection pipe having an odor inlet port and being set within the tubular hinge joint of the seat, and a tubular shaft being axially set within the connection pipe and communicating with a chimney pot through a vertical pipeline.

1. Background Art

As well known to those skilled in the art, conventional toilets are provided with a flushing mechanism designed to flush a toilet bowl so as to remove excrement while or after a user relieves one's bowels. However, such a conventional toilet is not provided with any means for sucking odor of excrements from its bowl, and so it regrettably allows a diffusion of odor of excrements from the bowl into the atmosphere within the limited space of a water closet until the toilet bowl is flushed. Of course, the diffused odor of excrements may be, thereafter, expelled into the atmosphere outside the water closet through a motor fan or a ventilation grille provided on the sidewall or the roof of the water closet. However, such conventional toilets are very inconvenient to users since the toilets force the user to suffer the diffused odor during defecation or urination. In order to offset such diffused odor within the limited space of a water closet, some people use an aromatic yielding a fragrant aroma. However, the aromatic merely offsets the diffused odor, but cannot radically such a diffusion of odor from toilet bowls, and so the users have to suffer such diffused odor during defecation or urination. It is thus required to propose a structurally improved toilet provided with a means for removing odor of excrement without allowing a diffusion of odor of excrements into the atmosphere within the limited space of a water closet while reliving one's bowels.

2. Disclosure of the Invention

Accordingly, the present invention has been made keeping in mind the above problems occurring in the prior art, and an object of the present invention is to provide a toilet and an odor exhausting apparatus for such toilets, which is designed to quickly suck odor of excrements from the toilet bowl to a chimney pot installed on the rooftop without allowing a diffusion of odor into the limited space of a water closet during defecation or urination, and which thus quickly expels the odor into the atmosphere outside the water closet through the chimney pot, and which always maintains the enclosed compartment of the water closet in a fresh, sanitary and hygienic state.

In order to accomplish the above object, the present invention provides a toilet and an odor exhausting apparatus for such toilets, comprising a plurality of odor suction ports formed on the lower wall of a hollow seat. The odor suction ports of the seat communicate with the atmosphere outside a house through an outlet port formed on the hinge joint of the seat, an inlet port of a connection pipe, an inlet port of a tubular shaft, and a vertical pipeline. Therefore, the toilet, provided with the odor exhausting apparatus, expels odor of excrements from the toilet bowl to the atmosphere outside the house through the suction ports and the vertical pipeline during defecation or urination.

In the present invention, the connection pipe rotatably connects the seat cover to the hinge joint of the seat, and has an inlet port. The inlet port of the connection pipe is selectively aligned with the outlet port of the seat so as to communicate with the interior of the toilet bowl through the cavity of the seat. The tubular shaft, having an inlet port, is set within the connection pipe, and communicates with the atmosphere outside the house via the vertical pipeline. During defecation or urination with the seat cover being fully opened, the toilet provided with the apparatus of this invention automatically and forcibly expels odor of excrements from the toilet bowl to the atmosphere due to suction force generated by rising air within the vertical pipeline.

In the preferred embodiment of this invention, the toilet comprises: an openable seat hinged to the top surface of a toilet bowl, said seat consisting of a cavity defined within said seat, a plurality of odor suction ports formed on the lower wall of the seat so as to suck odor from the toilet bowl into the cavity, and a tubular hinge joint provided at the rear end of the seat for hinging the seat to the toilet bowl, and communicating with said cavity through an odor outlet port; a hollow connection pipe rotatably set within the hinge joint, and having a first odor inlet port, with an externally-toothed engagement part being formed at each end of the connection pipe; a seat cover coupled to said connection pipe by two internally-toothed connection rings externally engaging with the externally-toothed engagement parts of the connection pipe; and a tubular shaft defining a cylindrical passage therein and having a second odor inlet port, said tubular shaft being axially and rotatably set within the hollow connection pipe, and rotatably held at opposite ends thereof on the toilet bowl by two support brackets mounted on the toilet bowl, with a vertical pipe extending from the passage of the tubular shaft to the atmosphere outside the house.

The odor exhausting apparatus for toilets according to the preferred embodiment of this invention consists of an openable seat and an openable seat cover, comprising: a cavity defined within said seat; a plurality of odor suction ports formed on the lower wall of the seat so as to suck odor from a toilet bowl into the cavity; a tubular hinge joint provided at the rear end of the seat for hinging the seat to the toilet bowl, said hinge joint communicating with said cavity through an odor outlet port; a hollow connection pipe rotatably set within the hinge joint, said connection pipe having a first odor inlet port, with an externally-toothed engagement part being formed at each end of the connection pipe; two connection rings formed on said seat cover so as to couple the seat cover to said connection pipe, said two connection rings being toothed on the internal surfaces thereof and externally engaging with the externally-toothed engagement parts of the connection pipe; a tubular shaft defining a cylindrical passage therein and having a second odor inlet port, said tubular shaft being axially and rotatably set within the hollow connection pipe, and rotatably held at opposite ends thereof on the toilet bowl using two support brackets mounted on the toilet bowl; and a vertical pipe connecting the passage of the tubular shaft to a vertical pipeline extending to the atmosphere outside a house, thus automatically expelling odor of excrements from the toilet bowl into the atmosphere outside the house due to suction force generated by ascending air within said vertical pipeline.

In the present invention, the toilet may have a conventional construction. In the preferred embodiment of this invention, the seat of the toilet defines a cavity therein, with a plurality of suction ports formed on the lower wall of the seat so as to suck odor from the toilet bowl into the cavity of the seat. The above seat is attached to the toilet bowl by a tubular hinge joint, with an outlet port formed on the joint so as to allow the joint to communicate with the interior of the toilet bowl through the cavity of the seat. The outlet port is formed on the sidewall of the joint, and may comprise one port or a plurality of ports.

In addition, the connection pipe is rotatably set within the tubular hinge joint of the seat, and is coupled to the seat cover so as to be rotatable along with the seat cover relative to the seat. In the preferred embodiment, such a connection of the seat cover to the connection pipe is accomplished by a toothed connection of the internally-toothed connection rings of the seat cover to the externally-toothed ends of the connection pipe. However, it should be understood that the connection structure provided at the junction of the seat cover and the connection pipe may be accomplished by a fitting structure or another structure using a separate locking means in place of the toothed structure without affecting the functioning of this invention. On the other hand, it is preferred to form one inlet port on the sidewall of the connection pipe so as to allow the inlet port to communicate with the interior of the toilet bowl through the outlet port of the seat when the seat cover is fully opened. However, the inlet port may be formed around the sidewall of the connection pipe in such a way that the inlet port of the connection pipe always communicates with the interior of the toilet bowl through the outlet port of the seat regardless of the angular position of the seat cover relative to the seat.

The tubular shaft is held at opposite ends thereof on the top surface of the toilet bowl by two brackets mounted to the top surface of the toilet bowl. This tubular shaft thus acts as a hinge shaft for both the seat and the seat cover, and acts as a passage for odor. That is, the tubular shaft communicates with the atmosphere outside a house through a vertical pipeline, thus guiding odor from the toilet bowl to the vertical pipeline so as to finally expel the odor to the atmosphere. In the present invention, the tubular shaft may be closed or opened at opposite ends thereof. When the opposite ends of the tubular shaft are closed, the tubular shaft is simply held by the two brackets at the closed opposite ends. However, when the opposite ends of the tubular shaft are opened, it is necessary to close the open ends by the two brackets during a process of holding the opposite ends of the tubular shaft by the brackets. In such a case, it is preferable to form a bearing recess on each of the brackets so as to allow the brackets to hold the ends of the tubular shaft at the bearing recesses while closing the ends. As a further alternative, the tubular shaft may be at least partially integrated with the brackets at its opposite ends. In such a case, it is necessary to form an opening on one of the two brackets so as to allow the interior of the tubular shaft to communicate with the vertical pipeline through the opening.

In the present invention, the vertical pipeline may be vertically set within a sidewall of a house or may be vertically arrayed on the external surface of the sidewall of the house. In the case of a multi-storied house, for example, an apartment house, it is preferable to use one of pipelines, previously set within the sidewall of the house during a building process, as the vertical pipeline. In most of conventional multi-storied houses or buildings, the pipelines extend to the atmosphere outside the rooftop, with motor fans typically installed at the top ends of the pipelines. Therefore, such pipelines effectively generate suction force therein, and are preferably usable as the vertical pipeline of this invention. When the toilets, installed on the floors of the stories of a multi-storied house, are commonly connected to such a pipeline through a plurality of horizontal pipes, it is possible to effectively and almost completely expel odor of excrements from the toilet bowls to the atmosphere outside the rooftop of the house without allowing a diffusion of odor from the toilet bowl into the limited spaces within the water closets having the toilets.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
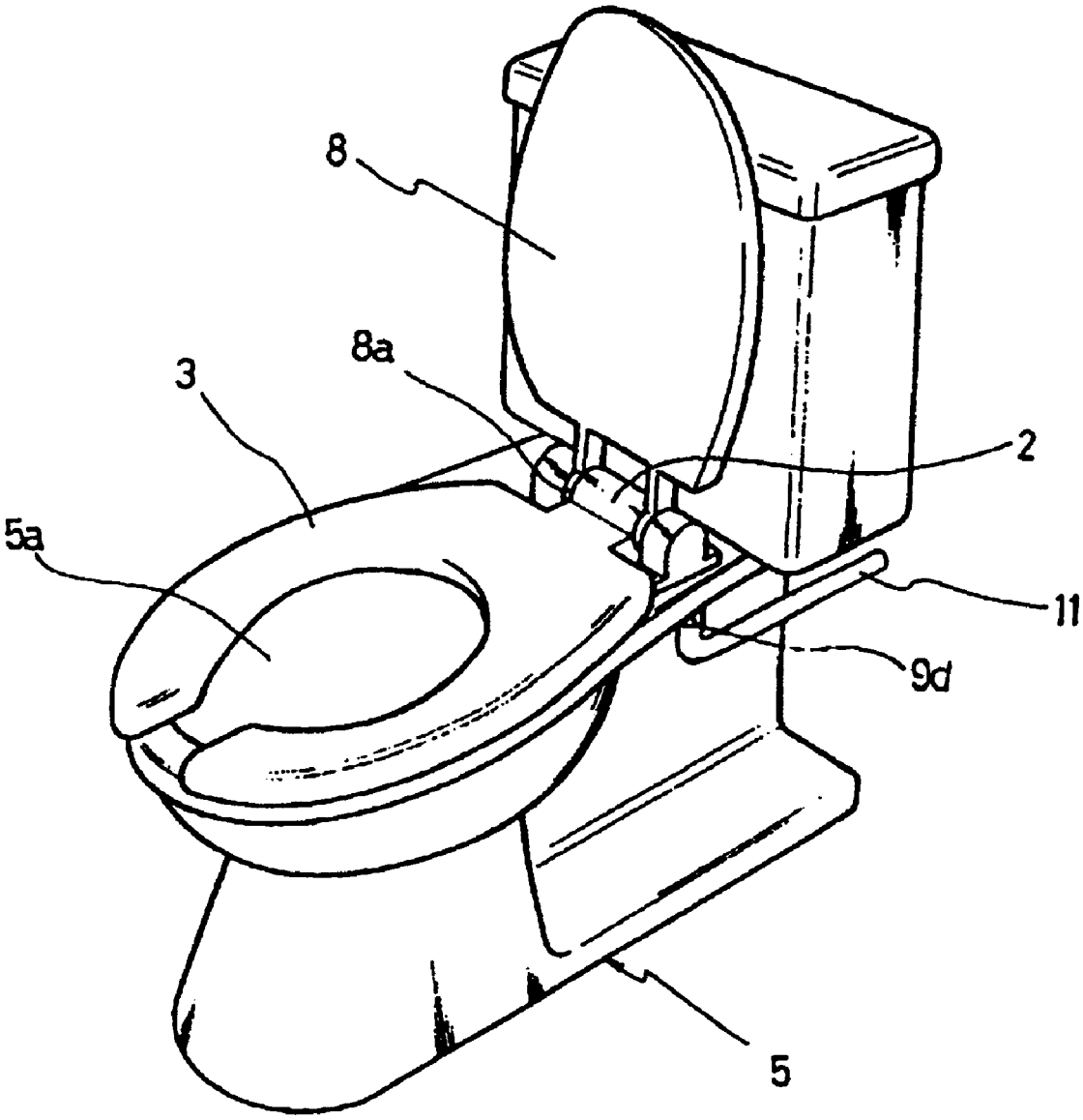
FIG. 1 is a perspective view of a toilet provided with an odor exhausting apparatus in accordance with the preferred embodiment of the present invention.

Reference now should be made to the drawings, in which the same reference numerals are used throughout the different drawings to designate the same or similar components.

FIG. 1 is a perspective view of a toilet provided with an odor exhausting apparatus in accordance with the preferred embodiment of this invention. As shown in the drawing, the toilet of this invention has a main body 5 including a toilet bowl 5*a*. An openable seat 3, having a tubular hinge joint 2 provided with an odor outlet port 1*e*, is hinged to the toilet body 5, with an openable seat cover 8 being rotatably coupled to the seat 3 at the tubular hinge joint 2 of the seat 3 as will be described herein below.

Figure 2:
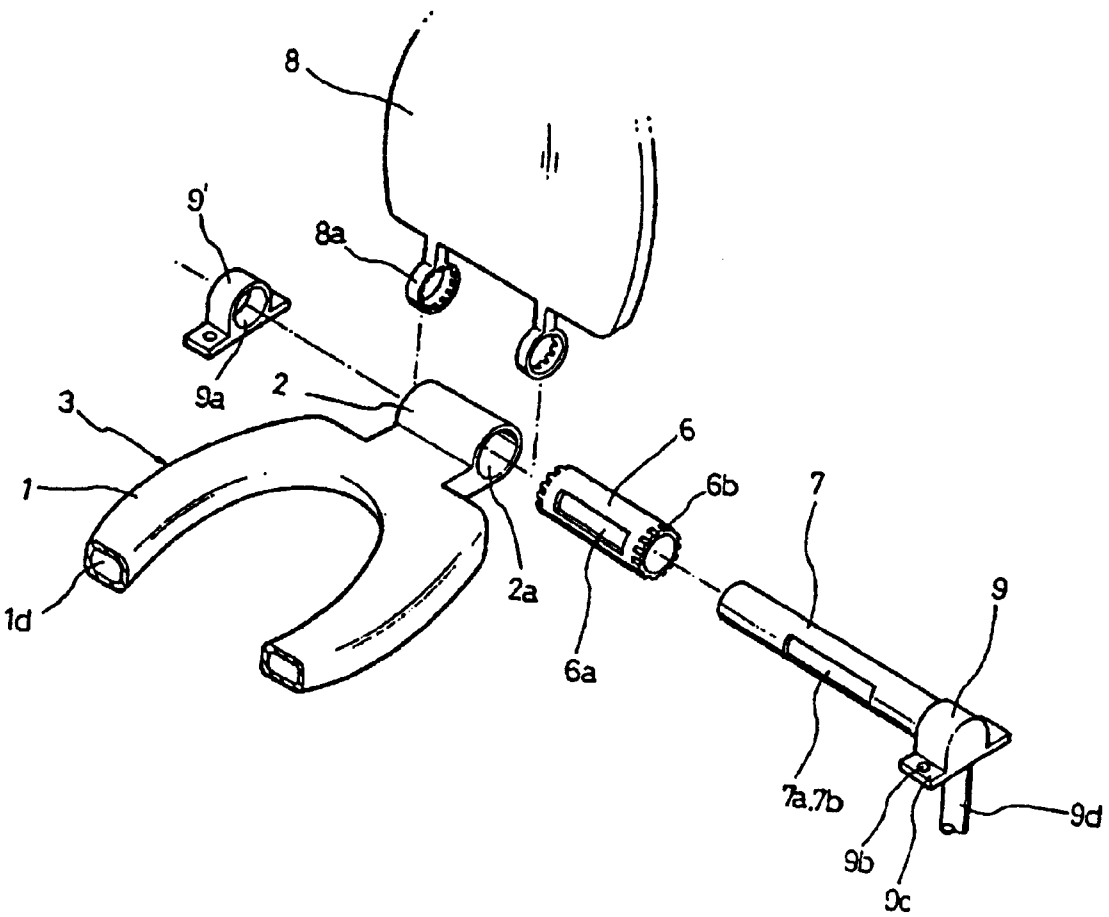
FIG. 2 is an exploded perspective view, showing the construction of the odor exhausting apparatus of the present invention.

FIG. 2 is an exploded view, showing the construction of the odor exhausting apparatus of this invention. As shown in the drawing, the seat 3 and the seat cover 8 rotatably coupled together by a hollow connection pipe 6. This connection pipe 6 has an odor inlet port 6*a*, and is fitted into the cylindrical interior 2*a* of the tubular hinge joint 2 of the seat 3. Each end of the hollow connection pipe 6 is regularly toothed along its external surface, thus having an externally-toothed engagement part 6*b*. On the other hand, the seat cover 8 has two connection rings 8*a*, which are spaced apart from each other by a gap corresponding to the length of the connection pipe 6. The two connection rings 8*a* are individually toothed on their internal surfaces, thus externally engaging with the eternally-toothed engagement parts 6*b* of the connection pipe 6. Due to such a toothed engagement of the two rings 8*a* of the seat cover 8 with the opposite ends of the connection pipe 6, the connection pipe 6 is rotatable along with the seat cover 8.

Figure 4:
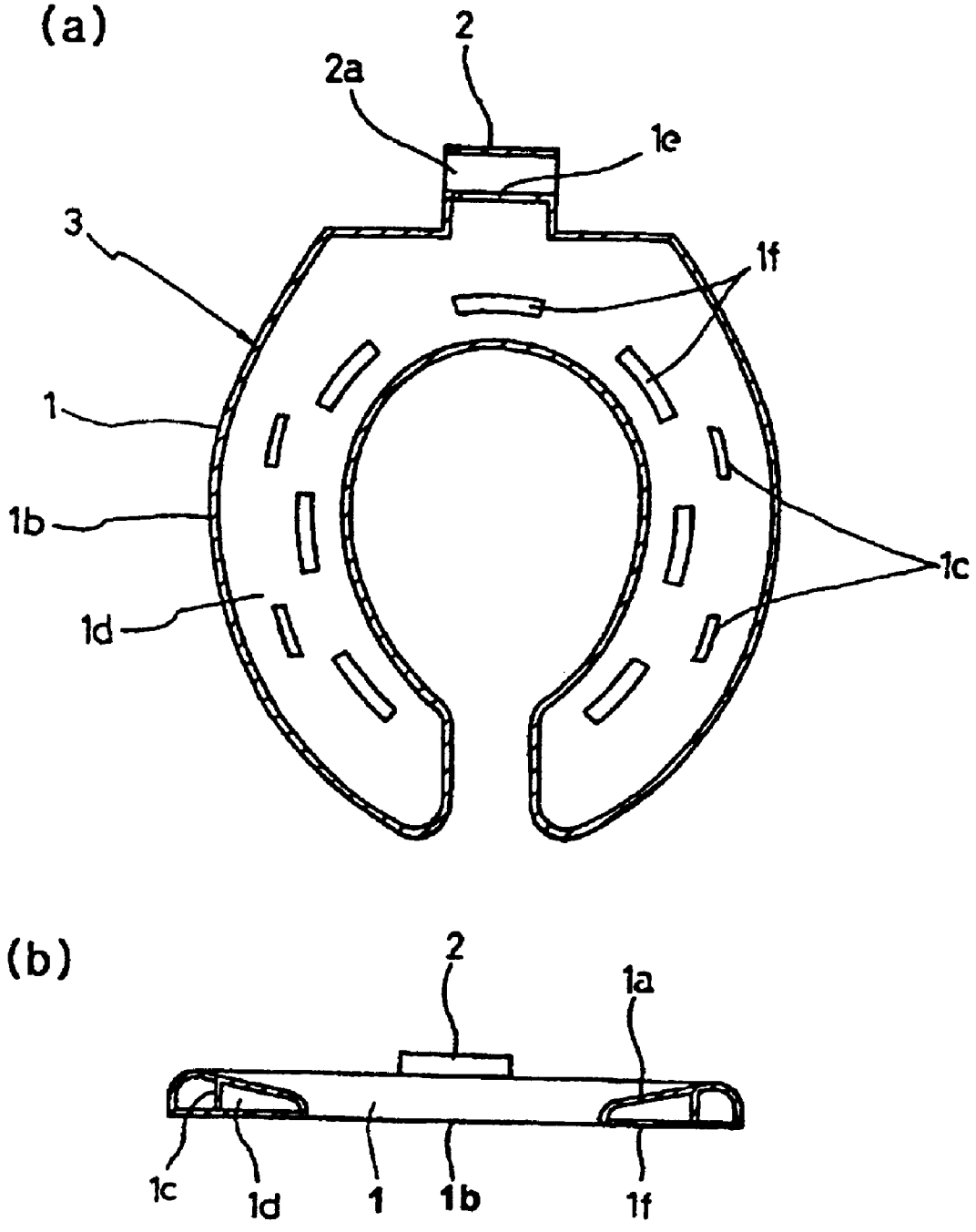
FIG. 4*a* is a horizontal sectioned view of the seat included in the toilet of this invention.
FIG. 4*b* is a vertical sectioned view of the seat included in the toilet of this invention.

FIGS. 4*a* and 4*b* are sectioned views of the seat 3 included in the toilet of this invention. As shown in the drawings, the seat 3 comprises an upper wall 1*a* and a lower wall 1*b*, with a cavity 1*d* being defined between the upper and lower walls 1*a* and 1*b*. A plurality of suction ports 1*f* are formed along the lower wall 1*b* of the seat 3 so as to suck odor of excrement from the interior of the toilet bowl 5*a* into the cavity 1*d*. A plurality of reinforcing pieces 1*c* are provided within the cavity 1*d* so as to reinforce the hollow structure of the seat 3. The odor outlet port 1*e* is formed at the sidewall of the tubular hinge joint 2 at a position around the main body of the seat 3.

A tubular shaft 7, of which the sidewall defines a cylindrical passage 7*b* therein and has an odor inlet port 7*a* at a predetermined position, is axially and rotatably set within the hollow connection pipe 6. The tubular shaft 7 is rotatably held on the toilet body 5 using two support brackets 9 and 9'. The two support brackets 9 and 9', holding the tubular shaft 7 on the toilet body 5 while covering the ends of the shaft 7, individually consist of a bearing with two mounting flanges 9*c*. Each of the two mounting flanges 9*c* has a screw hole 9*b*, and is mounted to the top surface of the toilet body 5 using a locking bolt. The tubular shaft 6 is rotatable within the connection pipe 6. A vertical short pipe 9*d* extends from one end of the tubular shaft 7, and is connected to a horizontal pipe 11 prior to being connected to a vertical pipeline 12. The vertical pipeline 12 extends to a chimney pot outside the rooftop.

Figure 3:
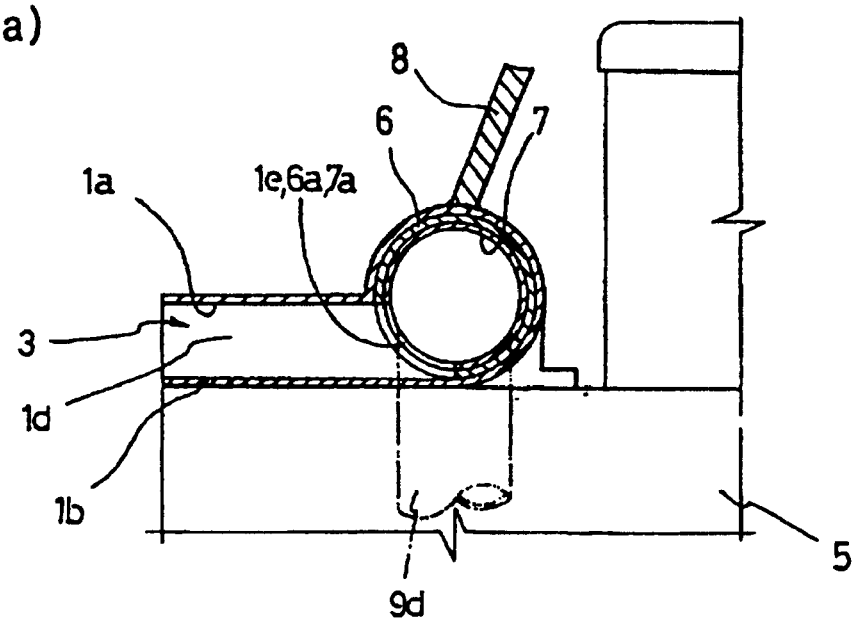
FIG. 3*a* is a sectional view, showing the important parts of the toilet provided with the odor exhausting apparatus of this invention, when the seat cover is opened.
FIG. 3*b* is a sectional view, showing the important parts of the toilet provided with the odor exhausting apparatus of this invention, when the seat cover is closed.
Figure 3:
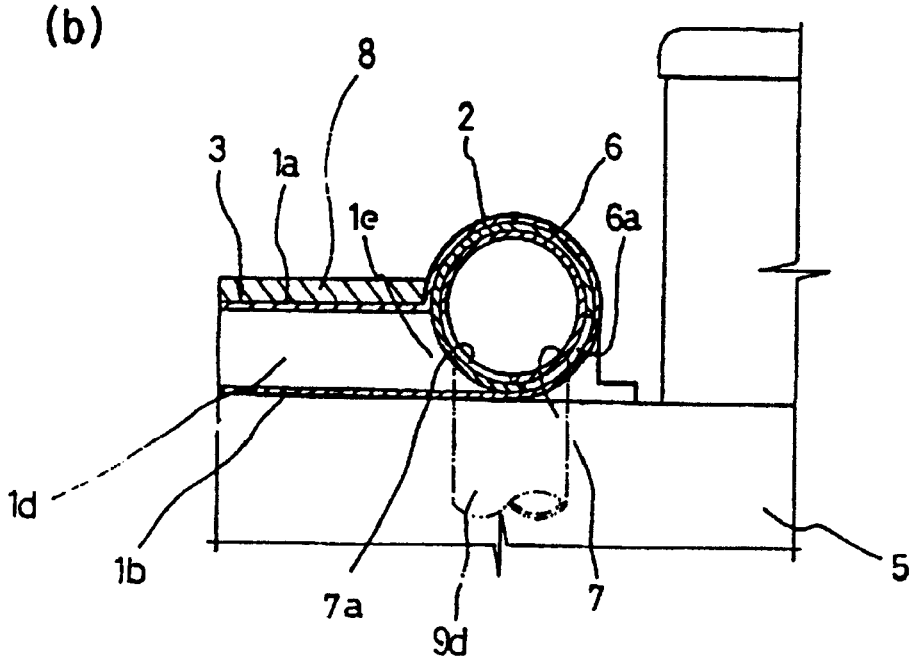

FIGS. 3*a* and 3*b* are views, showing the important parts of the toilet provided with the odor exhausting apparatus of this invention. When the seat cover 8 is rotated clockwise around the hinge joint in the drawing so as to open the bowl 5*a* as shown in FIG. 3*a*, the odor outlet port 1*e* of the seat 3 communicates with the odor inlet port 6*a* of the connection pipe 6. On the other hand, the odor outlet port 1*e* of the seat 3 is closed by the sidewall of the connection pipe 6, when the seat cover 8 is rotated counterclockwise around the hinge joint in the drawing so as to close the bowl 5*a* as shown in FIG. 3*b*. In addition, the odor inlet port 7*a* of the tubular shaft 7 is formed at a predetermined position, where the port 7*a* always communicates with the odor outlet port 1*e* of the seat 3. Therefore, the passage 7*b* of the shaft 7 is selectively opened or closed by the sidewall of the connection pipe 6 in accordance with a rotated position of the seat cover 8. In the odor exhausting apparatus of the present invention, the tubular hinge joint 2 of the seat 3, the connection pipe 6 and the tubular shaft 7 form an odor-expelling unit 10.

Figure 5:
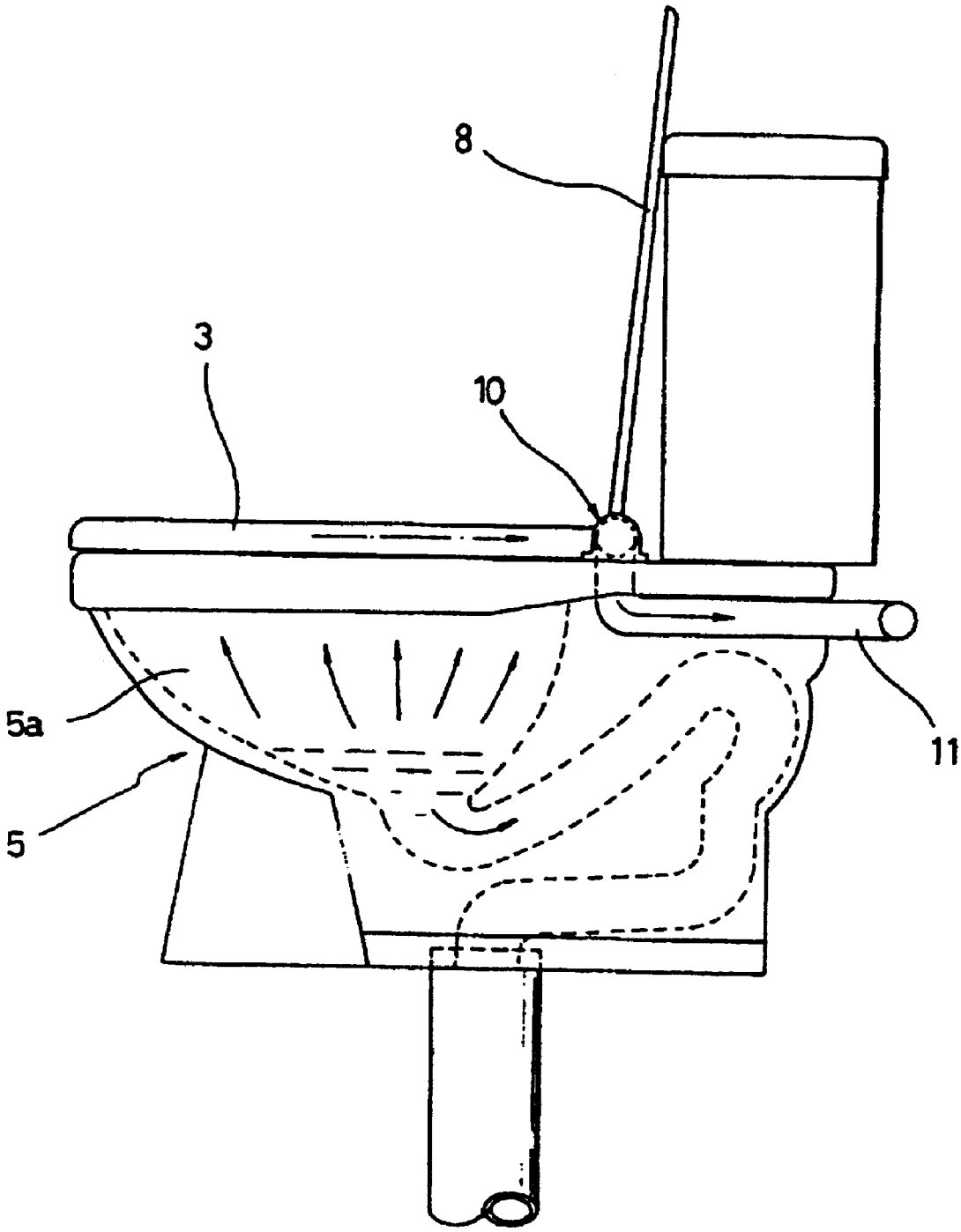
FIG. 5 is a side view of the toilet provided with the odor exhausting apparatus according to the present invention.

FIG. 5 is a side view of the toilet provided with the odor exhausting apparatus according to this invention. As shown in the drawing, the odor-expelling unit 10 is connected to the horizontal pipe 11, which communicates with the chimney pot outside the rooftop through the vertical pipeline 12. Therefore, odor of excrement within the toilet bowl 5*a* is expelled to the atmosphere outside a house through the odor-expelling unit 10 and the horizontal pipe 11.

When it is desired to use the toilet for defecation or urination, the seat cover 8 is primarily rotated around the hinge joint from its closed position to its open position. In such a case, the odor outlet port 1*e* of the hinge joint 2 of the seat 3, the odor inlet port 6*a* of the connection pipe 6, and the odor inlet port 7*a* of the tubular shaft 7 are aligned with each other so as to allow the cavity 1*d* of the seat 3 to communicate with the passage 7*b* of the tubular shaft 7. Therefore, odor of excrement within the toilet bowl 5*a* is sucked into the cavity 1*d* of the seat 3, and passes in order through the outlet port 1*e* of the seat, the inlet port 6*a* of the connection pipe 6, and the inlet port 7*a* of the tubular shaft 7 prior to being expelled into the atmosphere outside the house through the vertical pipeline 12. The toilet of this invention does not allow a diffusion of odor of excrements from the interior of the toilet bowl 5*a* into the limited space within the water closet, but almost completely expels the odor into the atmosphere outside the house.

Figure 6:
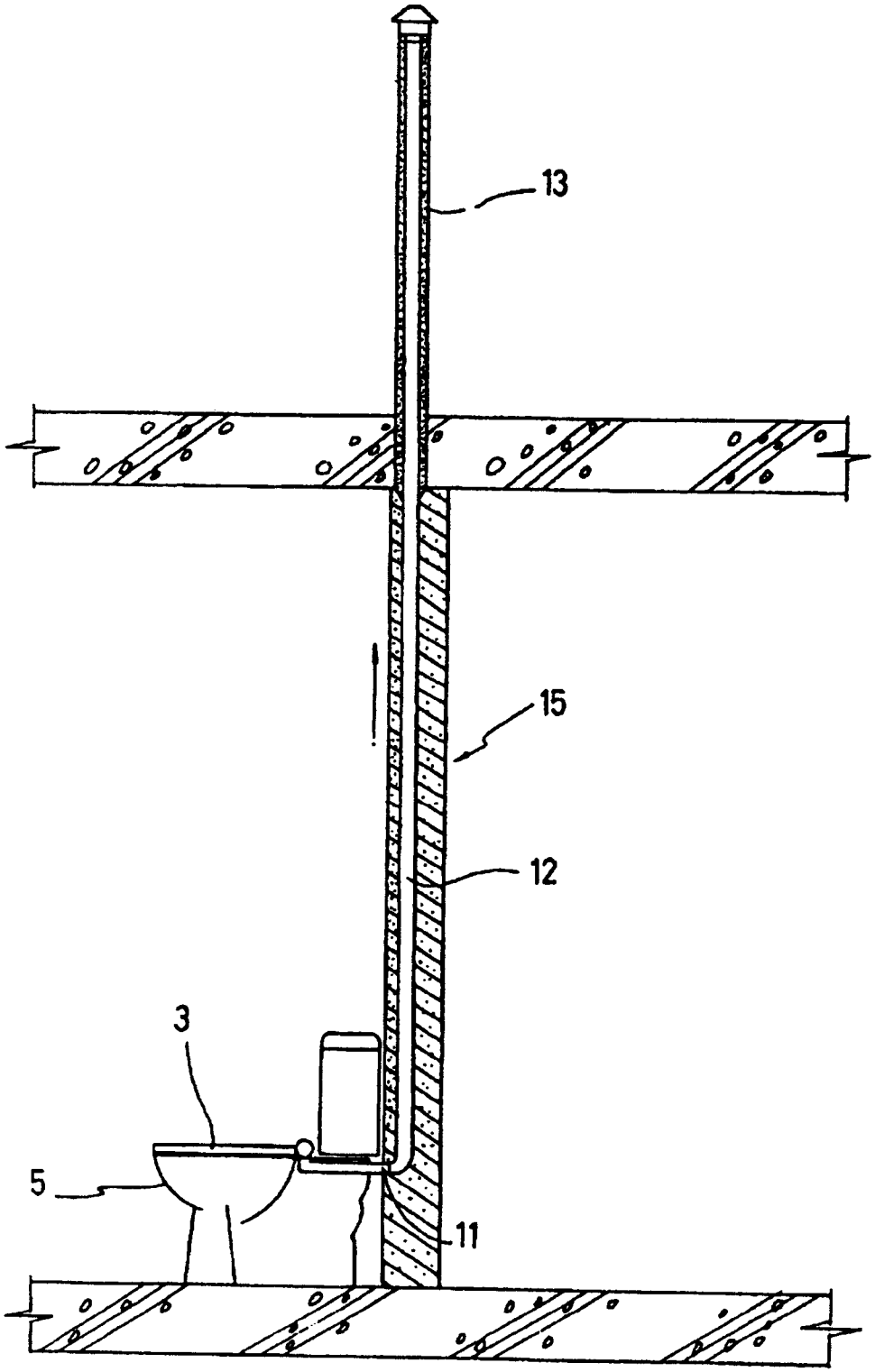
FIG. 6 is a view, showing an arrangement of the toilet and the odor exhausting apparatus according to the present invention, when they are used in a one-storied house.

FIG. 6 is a view, showing an arrangement of the toilet and the odor exhausting apparatus of this invention, when they are used in a one-storied house. As shown in the drawing, the odor-expelling unit 10 of a toilet communicates with an insulating double pipe 13 outside the rooftop of the one-storied house through the vertical pipeline 12.

Figure 7:
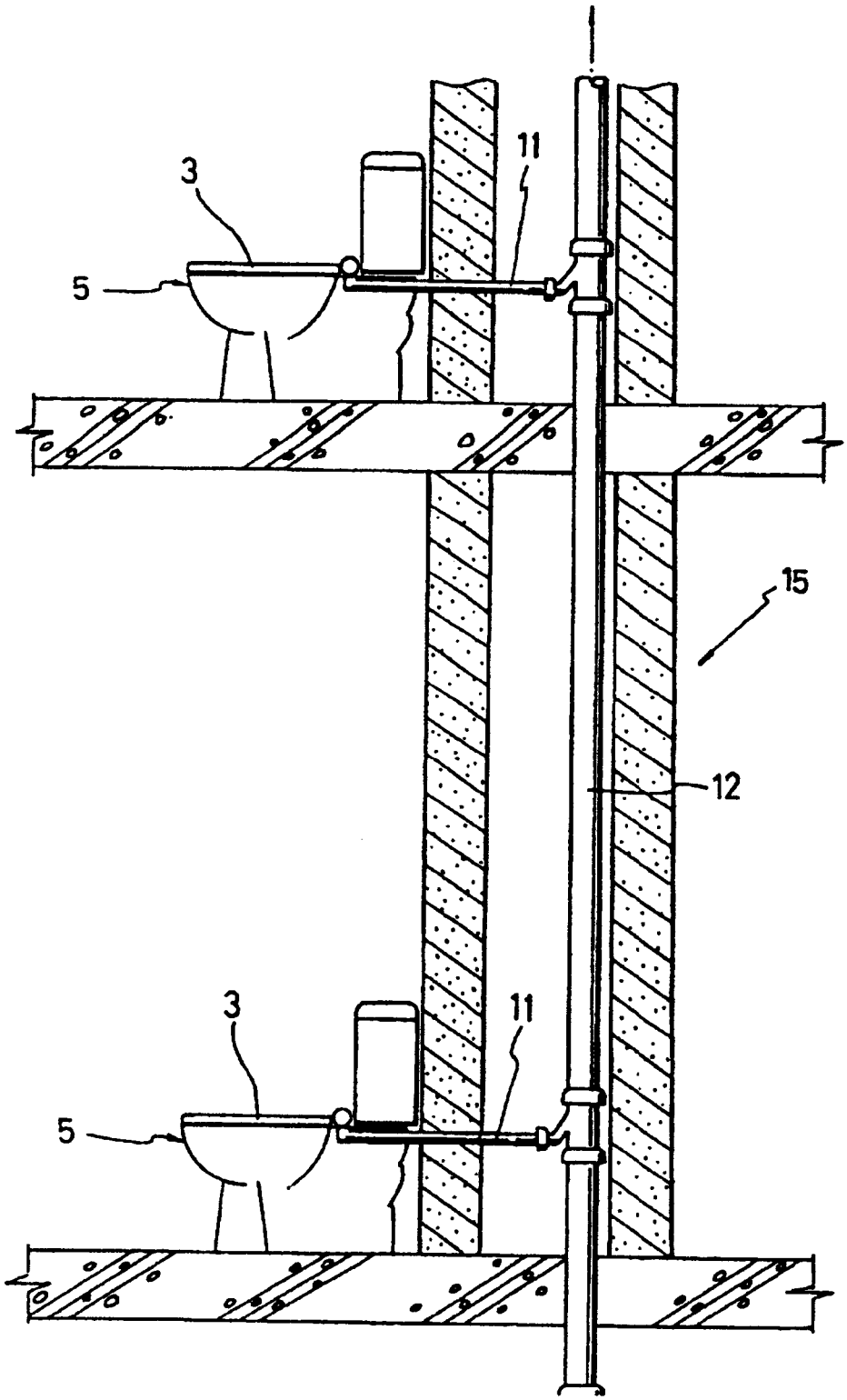
FIG. 7 is a view, showing an arrangement of the toilet and the odor exhausting apparatus according to the present invention, when they are used in a multi-storied house.

FIG. 7 is a view, showing an arrangement of the toilet and the odor exhausting apparatus of this invention, when they are used in a multi-storied house. As shown in the drawing, a vertical pipeline 12 is arranged to vertically pass through the stories of the house, with at least one toilet being installed within each story of the house and being connected to the vertical pipeline 12 through a horizontal pipe 11.

Figure 8:
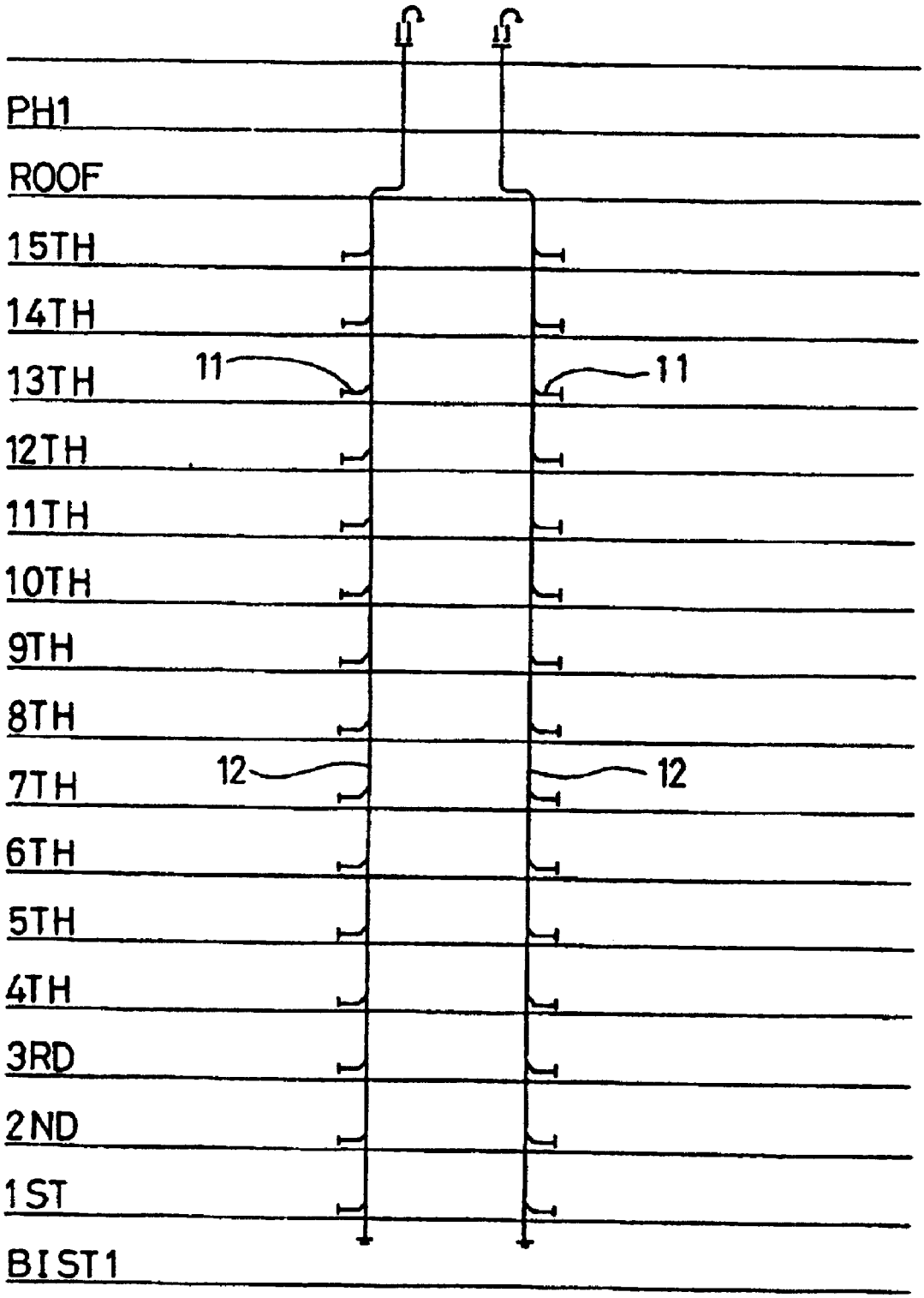
FIG. 8 is a view, showing an arrangement of the toilet and the odor exhausting apparatus according to the present invention, when they are used in a fifteen-storied apartment house.

FIG. 8 is a view, showing an arrangement of the toilet and the odor exhausting apparatus according to the present invention, when they are used in a fifteen-storied apartment house. As shown in the drawing, two or more vertical pipelines 12 are arranged to vertically pass through the stories of the house, with at least one toilet being installed within each home of the house and being connected to an associated vertical pipeline 12 through a horizontal pipe 11.

In the present invention a pipe, having a diameter of 35 mm, is preferably used as the horizontal pipe 11. In addition, the vertical pipeline 12 is fabricated using pipes having a diameter of at least 50 mm in the case of a one-storied house, or pipes having a diameter of at least 100 mm in the case of a multi-storied house in order to accomplish a smooth removal of odor.

When a user sits on the seat 3 of the toilet during defecation or urination, the buttocks of the user effectively close at least 80% of the opening of the toilet bowl 5*a*, and so odor of excrements cannot be diffused from the interior of the bowl 5*a* into the limited space of the water closet, but is automatically sucked into the cavity 1*d* of the seat 3 through the suction ports 1*f* formed on the lower wall of the seat 3 due to suction force generated by ascending air within the vertical pipeline 12. Thereafter, the odor from the cavity 1*d* passes through the exhaust port 1*e* of the seat 3, the inlet port 6*a* of the connection pipe 6, and the inlet port 7*a* of the tubular shaft 7 prior to being introduced into the horizontal pipe 11. The odor from the horizontal pipe 11 is expelled into the atmosphere outside the rooftop through the vertical pipeline 12.

INDUSTRIAL APPLICABILITY

As described above, the present invention provides a toilet and an odor exhausting apparatus for such toilets, designed to quickly suck odor of excrement from the toilet bowl to a chimney pot installed on the rooftop without allowing a diffusion of odor into the limited space of a water closet during defecation or urination. The toilet, with the odor exhausting apparatus, thus quickly expels odor into the atmosphere outside the water closet through the chimney pot, and always maintains the enclosed compartment of the water closet in a fresh, sanitary and hygienic state. The toilet with the odor exhausting apparatus of this invention allows a user to be free from using an aromatic, which has been conventionally used for offsetting odor within a water closet. In addition, the odor exhausting apparatus of this invention automatically sucks odor of excrements from the toilet bowl into the cavity of the seat, and forcibly expels the odor into the atmosphere outside the rooftop of a house due to suction force generated by ascending air within a vertical pipeline. Thereafter, it is not necessary for a user to install a separate motor fan on the wall of a water closet, and so the user can conserve electricity and save money.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A toilet, comprising:

an openable seat (3) hinged to a top surface of a toilet bowl, said seat (3) consisting of:

a cavity (1*d*) defined within said seat (3);

a plurality of odor suction ports (1*f*) formed on a lower wall (1*b*) of the seat (3) so as to suck odor from the toilet bowl into the cavity (1*d*); and a tubular hinge joint (2) provided at a rear end of the seat (3) for hinging the seat (3) to the toilet bowl, said hinge joint (2) communicating with said cavity (1*d*) through an odor outlet port (1*e*);

a hollow connection pipe (6) rotatably set within the hinge joint (2), said connection pipe (6) having a first odor inlet port (6*a*), with an externally-toothed engagement part (6*b*) being formed at each end of the connection pipe (6);

a seat cover (8) coupled to said connection pipe (6) by two connection rings (8*a*), said two connection rings (8*a*) being toothed on internal surfaces thereof and externally engaging with the externally-toothed engagement parts (6*b*) of the connection pipe (6); and a tubular shaft (7) defining a cylindrical passage (7*b*) therein and having a second odor inlet port (7*a*), said tubular shaft (7) being axially and rotatably set within the hollow connection pipe (6), and rotatably held at opposite ends thereof on the toilet bowl using two support brackets (9) and (9') mounted on the toilet bowl, with a vertical pipe (9*d*) extending from the passage (7*b*) of the tubular shaft (7) to the atmosphere outside a house.

2. The toilet according to claim 1, wherein the odor outlet port (1*e*) of the seat (3), the first odor inlet port (6*a*) of the connection pipe (6), and the second odor inlet port (7*a*) of the tubular shaft (7) are aligned with each other when the seat cover (8) is fully opened.

3. The toilet according to claim 1, wherein the opposite ends of said tubular shaft (7) are closed, with the vertical pipe (9*d*) communicating with the passage (7*b*) of the shaft (7).

4. The toilet according to claim 1, wherein a first end of said tubular shaft (7) is closed by the bracket (9'), while a second end of said tubular shaft (7) is integrated with the bracket (9'), with the vertical pipe (9*d*) communicating with the passage (7*b*) of the shaft (7) through an opening formed on the bracket (9).

5. An odor exhausting apparatus for toilets consisting of an openable seat and an openable seat cover, comprising:

a cavity (1*d*) defined within said seat (3);

a plurality of odor suction ports (1*f*) formed on a lower wall (1*b*) of the seat (3) so as to suck odor from a toilet bowl into the cavity (1*d*);

a tubular hinge joint (2) provided at a rear end of the seat (3) for hinging the seat (3) to the toilet bowl, said hinge joint (2) communicating with said cavity (1*d*) through an odor outlet port (1*e*);

a hollow connection pipe (6) rotatably set within the hinge joint (2), said connection pipe (6) having a first odor inlet port (6*a*), with an externally-toothed engagement part (6*b*) being formed at each end of the connection pipe (6);

two connection rings (8*a*) formed on said seat cover (8) so as to couple the seat cover (8) to said connection pipe (6), said two connection rings (8*a*) being toothed on internal surfaces thereof and externally engaging with the externally-toothed engagement parts (6*b*) of the connection pipe (6);

a tubular shaft (7) defining a cylindrical passage (7*b*) therein and having a second odor inlet port (7*a*), said tubular shaft (7) being axially and rotatably set within the hollow connection pipe (6), and rotatably held at opposite ends thereof on the toilet bowl using two support brackets (9) and (9') mounted on the toilet bowl; and a vertical pipe (9*d*) connecting the passage (7*b*) of the tubular shaft (7) to a vertical pipeline (12) extending to the atmosphere outside a house, thus automatically expelling odor of excrement from the toilet bowl into the atmosphere outside the house due to suction force generated by ascending air within said vertical pipeline (12).

6. The odor exhausting apparatus according to claim 5, wherein said vertical pipeline (12) is arranged to vertically pass through stories of a multi-storied house to reach the atmosphere outside the house, with a plurality of toilets installed on the stories and commonly connected to said vertical pipeline through horizontal pipes (11).

* * * * *